US007774912B2

(12) United States Patent
Gordon et al.

(10) Patent No.: US 7,774,912 B2
(45) Date of Patent: Aug. 17, 2010

(54) CONTINUOUSLY FORMED METAL MATRIX COMPOSITE SHAPES

(75) Inventors: Brian L. Gordon, Wheeling, WV (US); Gregg W. Wolfe, Wheeling, WV (US)

(73) Assignee: Touchstone Research Laboratory, Ltd., Triadelphia, WV (US)

( * ) Notice: Subject to any disclaimer, the term of this patent is extended or adjusted under 35 U.S.C. 154(b) by 319 days.

(21) Appl. No.: 10/995,279

(22) Filed: Nov. 24, 2004

(65) Prior Publication Data

US 2005/0191510 A1 Sep. 1, 2005

Related U.S. Application Data

(60) Provisional application No. 60/525,854, filed on Dec. 1, 2003, provisional application No. 60/525,853, filed on Dec. 1, 2003.

(51) Int. Cl.
*B21D 22/00* (2006.01)

(52) U.S. Cl. ..... 29/419.1; 29/527.2; 29/530

(58) Field of Classification Search ..... None
See application file for complete search history.

(56) References Cited

U.S. PATENT DOCUMENTS

| | | | | |
|---|---|---|---|---|
| 4,082,864 | A | 4/1978 | Kendall et al. | |
| 4,285,749 | A | 8/1981 | Stiles | |
| 4,649,060 | A | 3/1987 | Ishikawa et al. | |
| 4,659,593 | A * | 4/1987 | Rocher et al. | 427/310 |
| 4,728,387 | A | 3/1988 | Hilakos | |
| 4,886,202 | A | 12/1989 | Ammon et al. | |
| 5,049,419 | A * | 9/1991 | Kyono et al. | 427/251 |
| 5,540,797 | A | 7/1996 | Wilson | |
| 5,736,199 | A * | 4/1998 | Blucher | 427/430.1 |
| 6,131,285 | A | 10/2000 | Durand | |
| 6,329,056 | B1 * | 12/2001 | Deve et al. | 428/389 |
| 6,344,270 | B1 | 2/2002 | McCullough et al. | |
| 6,485,796 | B1 | 11/2002 | Carpenter et al. | |
| 6,660,088 | B2 | 12/2003 | Negishi et al. | |
| 2004/0190733 | A1 * | 9/2004 | Nayar et al. | 381/98 |
| 2005/0133123 | A1 * | 6/2005 | Joseph et al. | 148/437 |
| 2006/0060325 | A1 * | 3/2006 | Gordon et al. | 164/98 |
| 2006/0254744 | A1 * | 11/2006 | Gordon et al. | 164/98 |

FOREIGN PATENT DOCUMENTS

| | | | |
|---|---|---|---|
| DE | 2814773 | A1 | 10/1978 |
| EP | 0436807 | A | 7/1991 |
| EP | 1143028 | A | 10/2001 |

* cited by examiner

*Primary Examiner*—Jennifer C McNeil
*Assistant Examiner*—Jason L Savage
(74) *Attorney, Agent, or Firm*—Philip D. Lane

(57) ABSTRACT

Metal matrix composites having open or closed channels extending longitudinal through the length of the composite as well as methods and apparatus for forming the same are described. The shaped metal matrix composites are made of continuous fiber reinforced metal matrix composite materials. They have an integrally formed, non-cast, metal matrix composite body portion where the walls have a substantially uniform distribution of continuous fibers in a matrix metal throughout the volume of the walls and have at least one channel extending through the body of the shaped metal matrix composite.

9 Claims, 3 Drawing Sheets

CONTINUOUSLY FORMED METAL MATRIX COMPOSITE SHAPES

CROSS-REFERENCE TO RELATED APPLICATION

The present application claims priority to U.S. Provisional Patent Application No. 60/525,854, filed Dec. 1, 2003 and U.S. Provisional Patent Application No. 60/525,853, filed Dec. 1, 2003, each of which are specifically herein incorporated by reference in their entirety.

This invention was made with Government support under contract number DAAD19-01-2-0006 awarded by the Army Research Laboratory. The Government has certain rights in the invention.

FIELD OF THE INVENTION

The invention relates to metal matrix composite shapes and methods and apparatuses for making these shaped composites. More particularly, the invention relates to continuously formed, non-cast, metal matrix composite shapes that are integrally formed and have open or closed channels extending longitudinally through the shaped metal matrix composite.

BACKGROUND OF THE INVENTION

The next generation of high technology materials for use in aerospace and aircraft applications will need to possess high temperature capability combined with high stiffness and strength. Plates and shells fabricated from laminated metal matrix composites, as opposed to monolithic materials, provide the potential for meeting these requirements and thereby significantly advancing the designer's ability to meet the required elevated temperature and structural strength and stiffness specifications while minimizing weight.

These types of laminated metal matrix composites generally comprise relatively long continuous lengths of a reinforcing fibrous material, such as aluminum oxide, in a matrix of a metal, such as aluminum. Continuous fiber metal matrix composite structures may be generally formed by casting the molten matrix metal into a mold containing a preform of fibers. Pressure may be used to force the metal to surround the perform of fibers. The casting molds used in this type of process are expensive, with the cost dramatically increasing as the size of the mold increases.

Another method for forming shaped metal matrix composites includes a hot isothermal drawing process. This process involves the bonding of a plurality of metal infiltrated wires that have been laid-up in a particular shaped arrangement to produce extended lengths of fiber reinforced metal matrix composite shapes. The process of bonding the plurality of metal infiltrated wires can lead to a non-uniform distribution of the fibers throughout the thickness of the walls of the shaped metal matrix composite.

SUMMARY OF THE INVENTION

The invention is generally directed to integrally formed metal matrix composites having open or closed channels extending through the metal matrix composite. Open channels are those where there is access to the channel along a longitudinal surface of the metal matrix composite. Closed channels are those in which there is no access along a longitudinal surface of the metal matrix composite. Certain embodiments of the invention include an apparatus for shaping softened metal infiltrated fiber bundles. The apparatus may include an infiltration unit and a shaping die. The shaping die is adapted to shape softened metal infiltrated fiber bundles into a shaped metal matrix composite that has a channel extending through the length of the composite. The infiltration unit supplies the softened metal infiltrated fiber bundle to the shaping die.

In some embodiments, the shaping die may define a shaping throughbore having at least one wall configured to form a channel in the softened metal infiltrated fibers. Additionally, the shaping die may define a shaping throughbore having a cross-sectional shape selected from the group consisting of an I shape, V shape, L shape, U shape, C shape, S shape, H shape, Z shape, T shape, and the like.

In further embodiments, the shaping die may define a shaping throughbore adapted to form a closed channel extending through an interior portion of the shaped metal matrix composite. The shaping die may define a shaping throughbore having a cross-sectional shape selected from the group consisting of a circle, ellipse, oval, triangle, square, rectangle, regular polygon, irregular polygon, and other similar shapes. Further, the shaping die may include a shaping core extending into said shaping throughbore and spaced a distance from walls of said shaping throughbore. The shaping core may have a cross-sectional shape selected from the group consisting of a circle, ellipse, oval, triangle, square, rectangle, regular polygon, irregular polygon, and other similar shapes.

The invention also includes methods for forming shaped metal matrix composites. Certain embodiments include the steps of feeding a softened metal infiltrated fiber bundle through a shaping die and shaping said softened metal infiltrated fiber bundle to form a shaped metal matrix composite, where the shaped metal matrix composite defines a channel extending therethrough.

Other embodiments may include the step of infiltrating a fiber bundle with a metal to provide the softened metal infiltrated fiber bundle. Still further, the method may include the step of feeding the softened metal infiltrated fiber bundle continuously to form continuous lengths of shaped metal matrix composites.

The invention includes shaped metal matrix composites having an integrally formed, non-cast, metal matrix composite body-portion. The body portion may include a wall having a substantially uniform distribution of continuous fibers in a matrix metal throughout the volume of the wall. Further, the body portion has at least one channel extending longitudinally through said body portion. The shaped metal matrix composite may include a body portion that has at least two intersecting walls forming said channel. The shaped metal matrix composite may include a body portion that has at least one curved surface forming said channel. Further, the shaped metal matrix composite may have a cross-sectional shape selected from the group consisting of an I shape, V shape, L shape, U shape, C shape, S shape, H shape, Z shape, T shape, or other similar shapes. Further, the shaped metal matrix composite may include a body portion that defines a closed channel extending through an interior portion of the body portion. The body portion may have a shape selected from the group consisting of a circular tube, an oval tube, an elliptical tube, a rectangular tube, a square tube, a triangular tube, a polygonal tube, and irregular polygonal tube.

The shaped metal matrix composite may have a matrix metal selected from the group consisting of aluminum, magnesium, titanium, silver, gold, platinum, copper, palladium, zinc, including alloys, and combinations thereof. The shaped metal matrix composite may have fibers selected from the group consisting of carbon fibers, boron fibers, silicon carbide fibers, aluminum oxide fibers, glass fibers, quartz fibers, basalt fibers, ceramic fibers, metal fibers, and combinations thereof.

DETAILED DESCRIPTION OF THE INVENTION

The invention is generally directed to integrally formed, non-cast, shaped metal matrix composites having a channel extending longitudinally through the body of the composite structure as well as methods and apparatuses for forming the same. Generally, softened metal infiltrated fiber bundles are fed to a shaping die where they are formed into the shaped metal matrix composite. The softened metal is the matrix metal of the infiltrated fiber bundle that is in a molten state or at a temperature such that the matrix metal can be deformed with minimal force. Upon cooling, the matrix metal of the shaped metal matrix composite solidifies. The body of the shaped metal matrix composite has a wall with a substantially uniform distribution of continuous fibers in a matrix metal throughout the volume of the wall. Further, the body of the shaped metal matrix composite has at least one channel extending longitudinally through the body.

Figure 1:
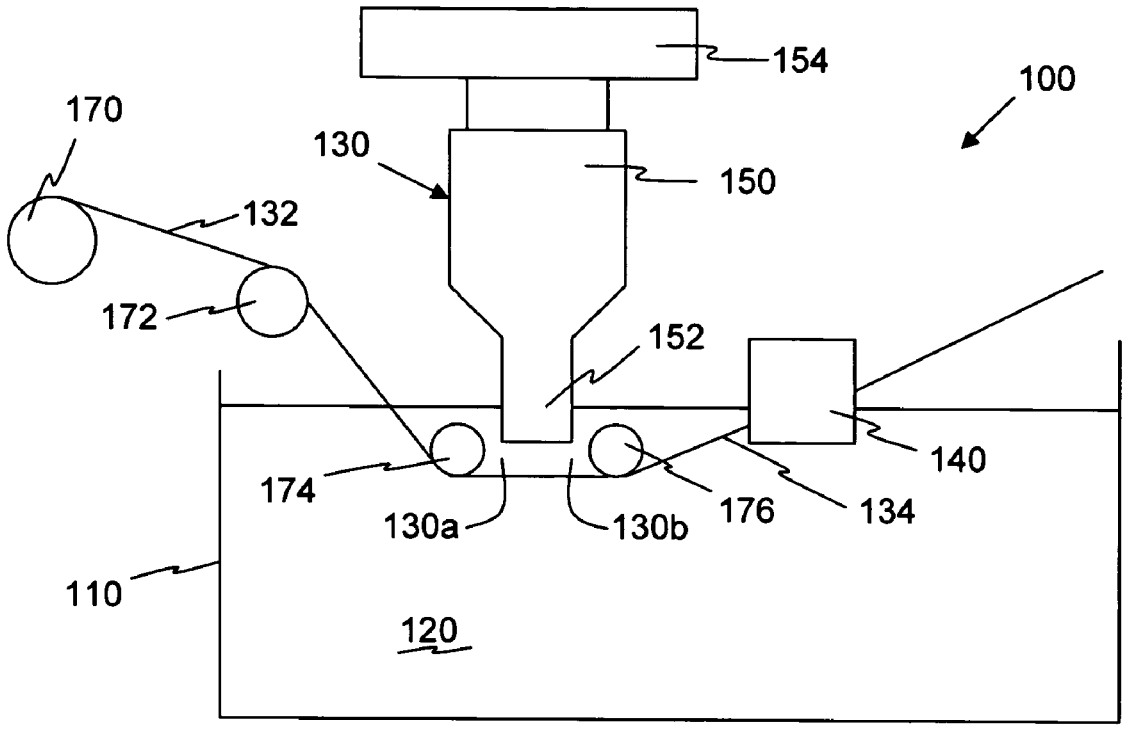
FIG. 1 is a diagrammatic view of a metal matrix composite shaping apparatus in accordance with an embodiment of the invention.

With reference now to FIG. 1, an illustration of a metal matrix composite shaping apparatus for forming metal matrix composite shapes in accordance with an embodiment of the invention is shown and generally depicted with the reference numeral 100. The metal matrix composite shaping apparatus 100 generally includes a furnace 110 containing a metal bath 120, a fiber bundle infiltration unit 130 that facilitates the wetting and infiltration of the matrix metal into one or more fiber bundles 132, and a shaping die 140 that shapes softened metal infiltrated fiber bundles 134 into the desired geometric shape and forms a shaped metal matrix composite in accordance with an embodiment of the invention. Infiltration generally refers to surrounding individual fibers in the fiber bundle with the matrix metal such that there is minimal or substantially no void space in the infiltrated fiber bundle.

Generally, any type of fiber that can maintain some characteristics of a fiber when exposed to the process temperatures and contact with the selected softened or molten metal may be used. Preferably, the fiber improved the mechanical and/or physical properties of the resulting metal matrix composite as compared to those of the matrix metal alone. Fibers, depending on the selected matrix metal, may include, but are not limited to, carbon fibers, boron fibers, silicon carbide fibers, aluminum oxide fibers, glass fibers, quartz fibers, basalt fibers, ceramic fibers, metal fibers, and the like.

The matrix metal is not particularly limited, as long as the matrix metal is capable of infiltrating the selected fiber bundle without destroying the selected fiber under the processing conditions used to form the consolidated metal matrix composite. Matrix metals, depending on the selected fibers, may include, but are not limited to, aluminum, magnesium, titanium, silver, gold, platinum, copper, palladium, zinc, including alloys, and combinations thereof.

As illustrated in FIG. 1, the metal matrix composite shaping apparatus includes a furnace 110 that contains a partially liquified or molten metal bath 120. The metal bath 120 includes the metal that will become the matrix metal of the resulting shaped metal matrix composite. The furnace 110 should be able to sustain a temperature sufficient to at least partially liquefy the metal used to form the molten metal bath 120. The size of the furnace is not critical and may vary considerably. In certain embodiments and as illustrated in FIG. 1, the size of the furnace 110 may be large enough such that a portion of the fiber infiltration unit 130 and the shaping die 140 may be submerged in the molten metal bath 120.

The function of the infiltration unit 130 is to infiltrate one or more fiber bundles 132 with metal from the metal bath 120. In certain embodiments, the infiltration unit 130 may include a sonic processor 150. The sonic processor 150 may comprise an ultrasonic processor and facilitates wetting and infiltration of the metal in the metal bath 120 into the fiber bundles 132. The sonic processor 150 may include a waveguide 152 for directing the sonic energy. The sonic processor may be one of a variety of commercially available units. The waveguide 152 should be able to withstand the conditions of the metal bath 120. The waveguide 152 may be fabricated from a number of materials such as titanium and niobium and alloys thereof. The frequency range and power output may be variably adjusted depending on factors such as the matrix metal, the types of fibers to be infiltrated, and the size and number of the fibers and fiber bundles. In certain embodiments, the waveguide 152 may include a double walled cooling chamber that allows continuous gas purge through the chamber. The ultrasonic processor 150 is preferably connected to a positioning device 154 that provides for adjusting the position of the waveguide 152. The positioning device 154 allows for the raising and lowering the waveguide 152 such that the distance between the waveguide and the fiber bundles 132 may be varied. In certain embodiments, the waveguide may be positioned near or below the surface of the metal bath 120. The fibers or fiber bundles should be positioned near the waveguide such that the fibers are caused to be infiltrated with the metal in the metal bath.

To assist in the handling and positioning of the fibers during the infiltration process, a series of rollers may be provided to orient and direct the fiber bundles into the metal bath and pass the fiber bundles near or across the waveguide. In the embodiment shown in FIG. 1, an initial fiber guide 170 may be used to receive the fiber bundles from a fiber supply source and initially orient the fibers or fiber bundles. A fiber orienting guide 172 may be provided to further orient and position the fiber bundles. In certain embodiments, the fiber orienting guide 172 may be a roller that contains a series of grooves around the circumference of the roller where the grooves are sized to receive and position the fibers or fiber bundles. The grooves help maintain the position of the fibers on the fiber orienting roller such that the fibers do not move laterally across the fiber orienting roller during operation. Further, one or more infiltration guides may be used to direct the fiber bundles in the metal bath and near or across the waveguide. A first infiltration guide 174 may be positioned near the input side 130*a* of the infiltration unit 130. A second infiltration guide 176 may be positioned near the output side 130*b* of the infiltration unit 130 such that the wave guide 152 is positioned between the first infiltration guide 174 and the second infiltration guide 176. The initial fiber guide 170, the fiber orienting guide 172, and the infiltration guides 174 and 176 may be rollers, cylinders, curved surface or other similar guides. Preferably the guides are configured such that the surface of the guide facilitates the movement of the fibers across the guide and reduces the breaking of the fibers as fibers move across the guides.

Still referring to FIG. 1, the shaping die 140 may be positioned near an output side 130*b* of the infiltration unit 130. The shaping die 140 may be used to shape the infiltrated fiber bundles 134 into the desired geometric shape and may also control the amount of the matrix metal accompanying the fiber bundle. The location of the shaping die 140 may vary depending on the application. The shaping die 140 may be located above, partially submerged, or completely submerged in the metal bath 120. The shaping die 140 may be connected to a positioning device that can adjust the position of the shaping unit vertically and horizontally.

Figure 2:
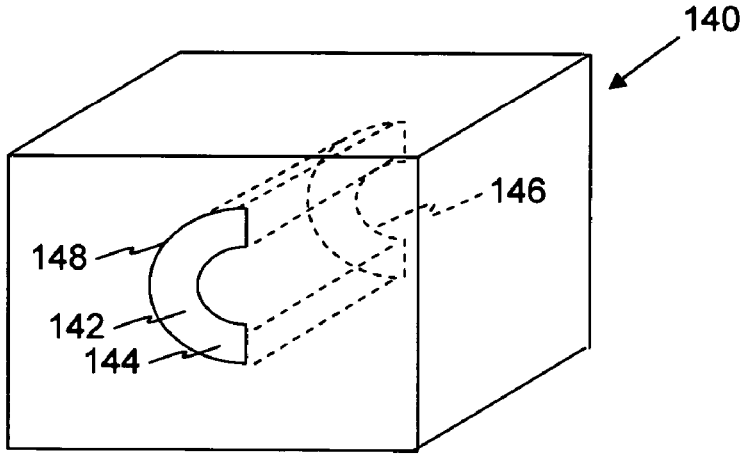
FIG. 2 is a view of a shaping die in accordance with an embodiment of the invention. The dashed lines represent the shaping throughbore extending through the die.

Turning now to FIG. 2, there is shown an embodiment of the shaping die 140. The die 140 has a die opening 142 adapted to receive the softened metal infiltrated fiber bundles. A shaping throughbore 144 extends from the die opening 142 to the die exit 146 and forms the softened metal infiltrated fiber bundles into the desired shape. The shaping throughbore 144 is configured to form a channel into the body of the shaped metal matrix composite and to substantially uniformly distribute the fibers throughout the area of the body the metal matrix composite.

To facilitate in the handling of the fiber bundles, the die opening 142 may have relieved or curved edges 148. Preferably the edges of the die opening are radiused. The radius of the edges is not particularly limited. Preferably, the radius of the edges is sufficient to reduce the likelihood of the fibers breaking due to the contact with the die opening.

The shaping throughbore 144 may have any number of cross-sectional geometric shapes, including, but not limited to, I shape, V shape, L shape, U shape, C shape, S shape, H shape, Z shape, T shape, and the like. Depending on the cross-sectional shape of the shaping throughbore 144, the resulting metal matrix composite will have a corresponding matching cross-sectional shape such as I shape, V shape, L shape, U shape, C shape, S shape, H shape, Z shape, T shape, and the like.

Figure 3:
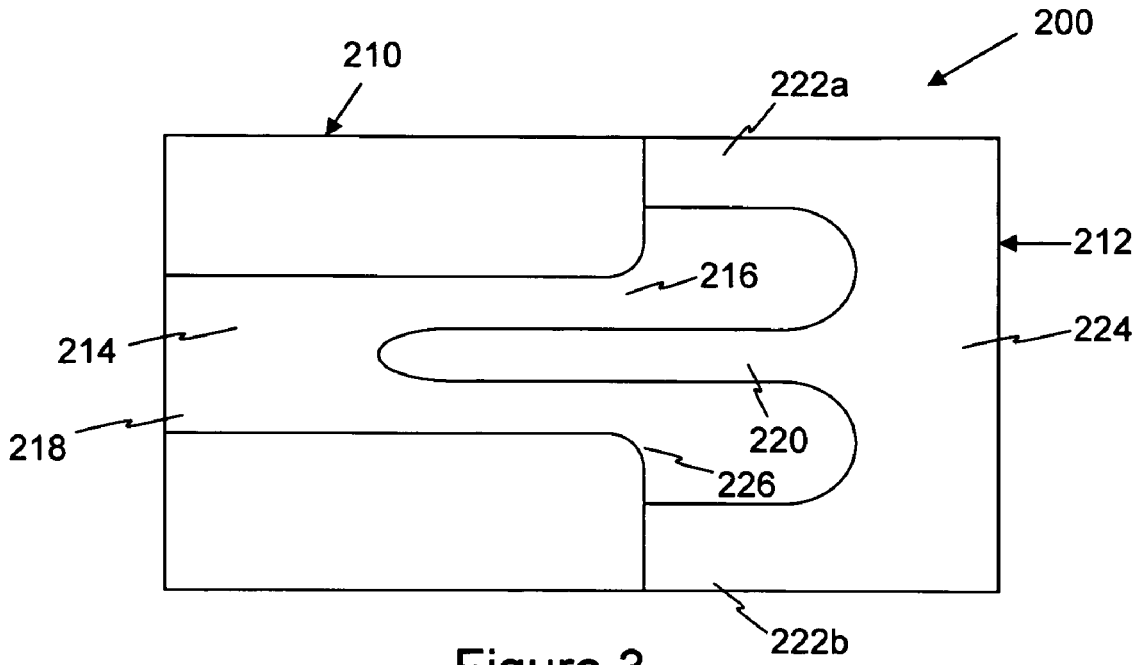
FIG. 3 is a cross-sectional view of a shaping die in accordance with an embodiment of the invention.
Figure 4:
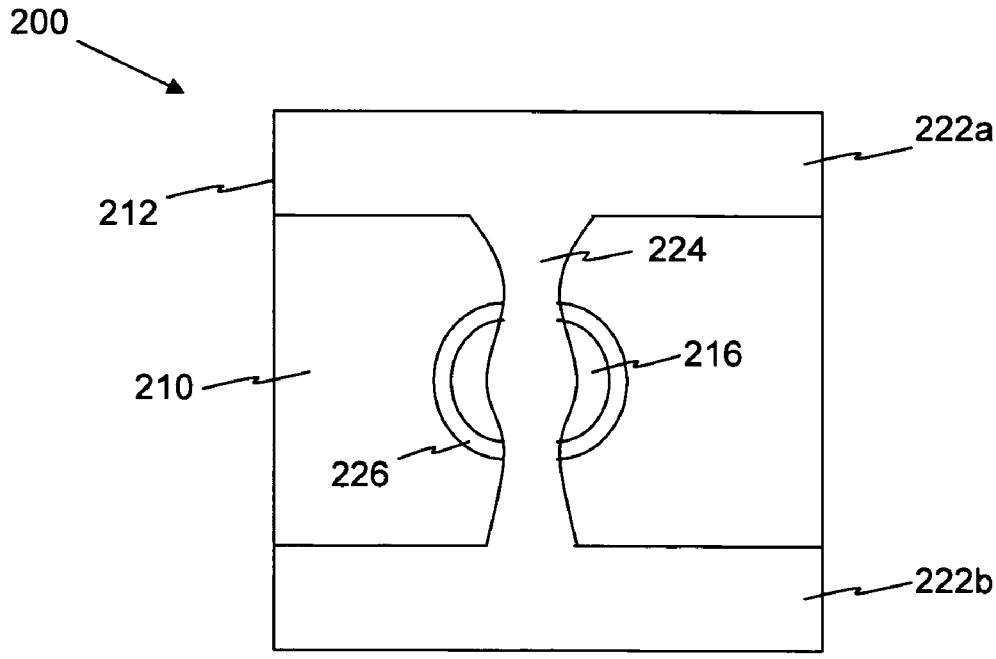
FIG. 4 is an end view of the shaping die shown in FIG. 3.

Turning now to FIGS. 3 and 4, another embodiment of a shaping die 200 is illustrated. The die 200 is adapted to form a closed channel extended longitudinally through the resulting shaped metal matrix composite. In the embodiment illustrated in FIG. 3, the shaping die 200 has a main body 210 and a coring insert 212. The main body 210 defines a shaping throughbore 214 having a cross-sectional shape selected from the group consisting of a circle, ellipse, oval, triangle, square, rectangle, regular polygon, and irregular polygon. The shaping throughbore 214 extends from the die opening 216 to the die exit 218. The coring insert 212 includes a shaping core 220 that is sized to be received into the shaping channel 214 and spaced a distance from walls of said shaping channel 214. The shaping core 220 is connected to support blocks 222*a* and 222*b* by a bridge 224. The cross-sectional shape of the shaping core 220 is not particularly limited and may include, but is not limited to, a circle, ellipse, oval, triangle, square, rectangle, regular polygon, and irregular polygon and will define the shape of the closed channel of the resulting shaped metal matrix composite.

To facilitate in the handling of the fiber bundles, the die opening 216 has relieved or curved edges 226. Preferably the edges of the die opening are radiused. The radius of the rounded edges is not particularly limited. Preferably, the radius of the edges is sufficient to reduce the likelihood of the fibers breaking due to the contact with the die opening. Further, the bridge 224 may be shaped to provide contoured surfaces to minimize the breaking of fibers as they pass over the bridge 224 and into the die opening 216. The resulting shaped metal matrix composite may have a variety of cross-sectional shapes such as, a circular tube, an oval tube, an elliptical tube, a rectangular tube, a square tube, a triangular tube, a regular polygonal tube, and irregular polygonal tube.

The shaping die should be constructed of a material that can maintain its shape and structural integrity when exposed to the metal bath and infiltrated fiber bundles. For many applications, the die may be fabricated from graphite, metals, or suitable ceramic or refractory materials.

In an alternative embodiment of the metal matrix composite shaping apparatus, the infiltration unit 130 may be eliminated by drawing pre-infiltrated metal matrix composite tapes or wires through the molten metal bath 120 and shaping die 140 followed by shaping the infiltrated metal matrix composite. By drawing the pre-infiltrated metal matrix composite through the molten metal bath, the matrix metal is softened to allow for shaping in the shaping die.

For illustrative purposes and not to limit the invention, a method for shaping a metal matrix composite in accordance with an embodiment of the invention will be described. The method may generally include shaping a softened infiltrated fiber bundle by pulling softened metal infiltrated fiber bundles through a shaping unit.

With reference to FIG. 1, the fiber bundle 140 may be continuously fed to the infiltration unit 130 and immersed into the metal bath 120. The molten metal may be degassed during and/or prior to infiltration to reduce the amount of gas, such as hydrogen, in the softened metal. Where the fibers enter or exit the metal bath, it may be advantageous to provide an inert gas such as nitrogen or argon around the point of entry to minimize the formation of a metal oxide film on the surface of the metal bath. As the fiber bundles enter or exit the bath, this film may get picked up by the fiber bundles producing defects in the infiltrated fiber bundle or resulting metal matrix composite.

As the fiber bundle passes through the infiltration unit 130, the fibers pass near the sonic waveguide 152. The waveguide 152 directs ultrasonic energy through the fibers and into the metal bath surrounding the fibers. The metal wets the fibers so that each individual fiber of the fiber bundle is substantially surrounded or encapsulated by the metal, preferably leaving no or minimal void spaces and forms a softened metal matrix infiltrated fiber bundle 134.

The softened metal matrix infiltrated fiber bundles 134 are pulled through the shaping die 140 to shape the infiltrated fiber bundle and control the fiber density of the infiltrated fiber bundle. Preferably the softened metal infiltrated fiber bundles are continuously pulled through the shaping die 140. Pulling the fiber bundles through the die may be accomplished by any variety of methods such as a dual belt pulling mechanism that grips the material exiting the shaping die 140 and pulls the material away from the die at a controlled rate. Upon cooling, the matrix metal in the composite solidifies to form a shaped metal matrix composite that is relatively rigid and can be used to form parts and other structures.

The shaping die 140 produces a shaped metal matrix composite having an open or closed channel. The body of the resulting shaped metal matrix composite typically has a substantially uniform distribution of continuous fibers in a matrix metal throughout the volume of the walls making up the composite. The resulting metal matrix composite will have a cross-sectional shape that corresponds to the cross-sectional shape of the shaping die, such as, I shape, V shape, L shape, U shape, C shape, S shape, H shape, Z shape, T shape, and the like. In the case of closed channel structures the shape of the resulting metal matrix composite may include, but is not limited to a circular tube, an oval tube, an elliptical tube, a rectangular tube, a square tube, a triangular tube, a regular polygonal tube, and irregular polygonal tube.

Figure 5:
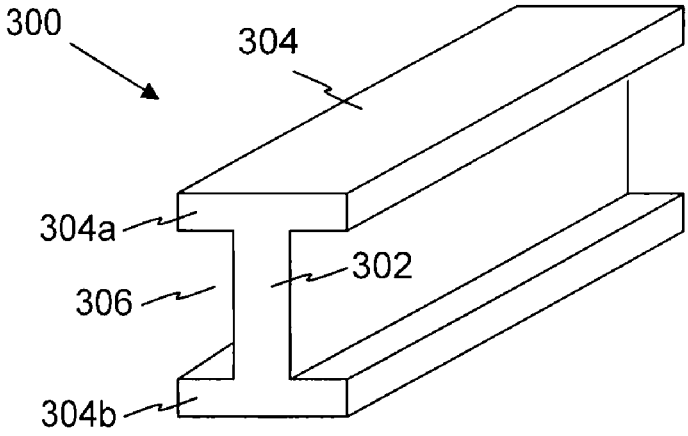
FIG. 5 is a perspective view of a shaped metal matrix composite in accordance with an embodiment of the invention.

Without intending to limit the scope of the invention, the integrally formed, non-cast, shaped metal matrix composites in accordance with certain embodiments of the invention will generally be described. With reference to FIG. 5, a shaped metal matrix composite 300 having an I shaped cross-section is illustrated. The shaped metal matrix composite 300 has an integrally formed, non-cast, metal matrix composite body portion 302. The body portion 302 may include one or more walls 304 having a substantially uniform distribution of continuous fibers in a matrix metal throughout the volume of the wall. The body portion 302 has at least one channel 306 extending longitudinally through said body portion. The channel 306 is an open channel in that there is access to the channel along a longitudinal side of the body portion 302. The shaped metal matrix composite 300 may include a body portion 302 that has at least two intersecting walls 304*a* and 304*b* forming said channel.

Figure 6:
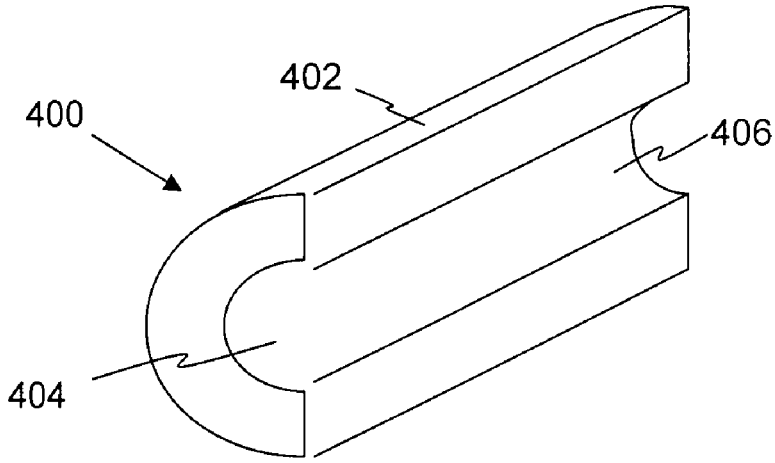
FIG. 6 is a perspective view of a shaped metal matrix composite in accordance with another embodiment of the invention
Figure 7:
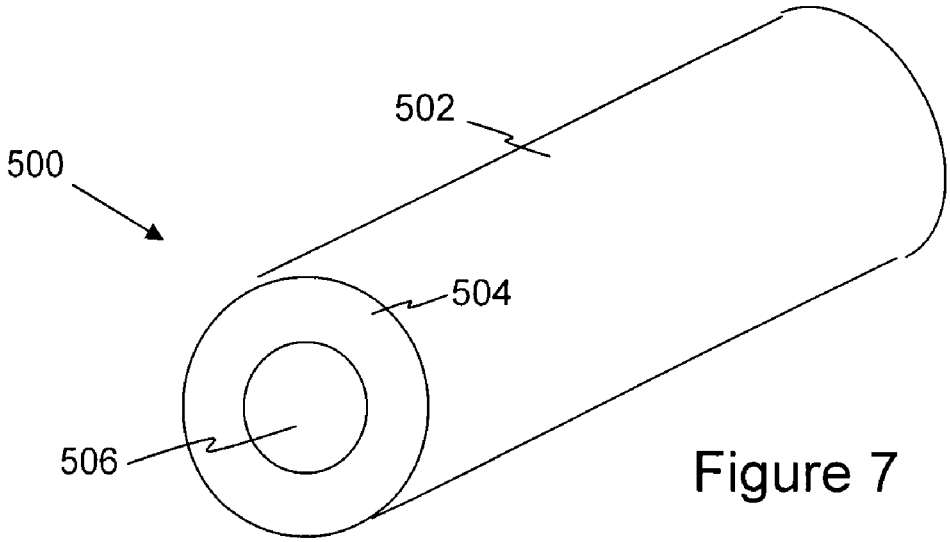
FIG. 7 is a perspective view of a shaped metal matrix composite in accordance with an additional embodiment of the invention.

Another embodiment of a shaped metal matrix composite 400 having a C-shaped cross-section is illustrated in FIG. 6, where the body portion 402 that has at least one curved surface 404 forming the channel 406. The channel 406 is an open channel extending longitudinally through the body portion 402. In general, as discussed above, the shaped metal matrix composite may have any number of cross-sectional shapes, including, but not limited to, I shape, V shape, L shape, U shape, C shape, S shape, H shape, Z shape, T shape and other similar shapes.

With reference now to FIG. 6, another embodiment of a shaped metal matrix composite 500 having a tubular shape with a closed channel is illustrated. The shaped metal matrix composite 500 has an integrally formed, non-cast, metal matrix composite body portion 502. The body portion 502 includes one or more walls 504 that have a substantially uniform distribution of continuous fibers in a matrix metal throughout the volume of the wall. The walls 504 define a closed channel 506 extending through an interior portion of the body portion 502. The closed channel 506 is closed in that there is no access to the channel along a longitudinal side of the body portion 502.

The body portion 502 may have any number of cross-sectional shapes and is not particularly limited. The shape of the body portion may include, but is not limited to, circular tube, an oval tube, an elliptical tube, a rectangular tube, a square tube, a triangular tube, a regular polygonal tube, and an irregular polygonal tube, and the like. The cross-sectional shape of the closed channel 506 depends on the shape of the shaping core used to form the composite. The cross-sectional shape of the closed channel can have any number of shapes. The cross-sectional shapes may include, but are not limited to, a circle, ellipse, oval, triangular, square, rectangle, regular polygon, irregular polygon, and the like.

The above examples are not to be considered limiting and are only illustrative of a few of the many types of embodiments of the present invention. The present invention may be varied in many ways without departing form the scope of the invention and is only limited by the following claims.

What is claimed is:

1. A method for forming a shaped metal matrix composite, comprising the steps of:

infiltrating a fiber bundle with a metal by passing the fiber bundle through a metal bath to create a softened metal infiltrated fiber bundle;

pulling a softened metal infiltrated fiber bundle through a shaping die, wherein said shaping die is at least partially submerged in said metal bath; and shaping said softened metal infiltrated fiber bundle to form a shaped metal matrix composite, wherein said shaped metal matrix composite defines a channel extending therethrough.

2. The method of claim 1, further comprising the step of infiltrating a fiber bundle with a metal to provide said softened metal infiltrated fiber bundle.

3. The method of claim 2, wherein the step of infiltrating a fiber bundle with a metal to provide said softened metal infiltrated fiber bundle comprising passing fiber bundles near an ultrasonic waveguide.

4. The method of claim 1, wherein said shaping die defines a shaping throughbore having at least one wall configured to form a channel in the softened metal infiltrated fibers.

5. The method of claim 1, wherein said shaping die defines a shaping throughbore having a cross-sectional shape selected from the group consisting of an I shape, V shape, L shape, U shape, C shape, S shape, H shape, Z shape, T shape.

6. The method of claim 1, wherein said shaping die defines a shaping throughbore adapted to form a closed channel extending through an interior portion of the shaped metal matrix composite.

7. The method of claim 1, wherein said shaping die has walls that define a shaping throughbore having a cross-sectional shape selected from the group consisting of a circle, ellipse, oval, triangle, square, rectangle, regular polygon, and irregular polygon, and wherein said shaping die further comprises a shaping core extending into said shaping throughbore and spaced a distance from the walls of said shaping throughbore.

8. The method of claim 7, wherein said shaping core has a cross-sectional shape selected from the group consisting of a circle, ellipse, oval, triangle, square, rectangle, regular polygon, and irregular polygon.

9. The method of claim 1, wherein the step of pulling said softened metal infiltrated fiber bundle is done continuously to form continuous lengths of shaped metal matrix composites.

* * * * *